US007229001B2

(12) United States Patent
Wang

(10) Patent No.: US 7,229,001 B2
(45) Date of Patent: Jun. 12, 2007

(54) FOLDING COLLAPSIBLE RECTANGULAR STORAGE BOX

(76) Inventor: Wen-Tsan Wang, PO Box 82-144, Taipei (TW)

( * ) Notice: Subject to any disclaimer, the term of this patent is extended or adjusted under 35 U.S.C. 154(b) by 206 days.

(21) Appl. No.: 11/030,915

(22) Filed: Jan. 10, 2005

(65) Prior Publication Data

US 2006/0151583 A1 Jul. 13, 2006

(51) Int. Cl.
*B65D 5/36* (2006.01)

(52) U.S. Cl. ..... 229/117.05; 220/4.29; 229/122.27; 229/122.34; 229/125.19

(58) Field of Classification Search ..... 229/117.01, 229/117.06, 125.19, 122.27, 122.34, 162.6, 229/117.05, 117.07, 117.08; 220/6, 62, 4.28, 220/4.29, 4.32

See application file for complete search history.

(56) References Cited

U.S. PATENT DOCUMENTS 664,835 A * 1/1901 Czarniecki ..... 229/117.08
1,912,952 A * 6/1933 Scruby ..... 229/162.6
1,977,467 A * 10/1934 Bomberger et al. .... 229/125.08
2,485,028 A * 10/1949 Bauernfreund et al. ..... 220/6
2,878,488 A * 3/1959 Doskocil ..... 229/117.01
3,180,555 A * 4/1965 Barrett ..... 229/117.01
3,567,106 A * 3/1971 Anderson ..... 229/186
3,684,155 A * 8/1972 Smith ..... 229/117.07
3,856,064 A * 12/1974 Swalleri ..... 229/117.01
5,042,713 A * 8/1991 Stafford ..... 229/125.19
5,586,679 A * 12/1996 Thomas ..... 229/117.07
5,913,473 A * 6/1999 Wang ..... 229/120.07
7,011,224 B2 * 3/2006 Sheng-Bin ..... 220/6

* cited by examiner

*Primary Examiner*—Gary E. Elkins
(74) *Attorney, Agent, or Firm*—Leong C. Lei

(57) ABSTRACT

Disclosed is a folding collapsible rectangular storage box in which the rectangular box body has a flexible bottom panel, two short upright peripheral panels and two long upright peripheral panels perpendicularly extending upward from the four sides of said rectangular bottom panel, the two long upright peripheral panels having a respective vertically extending folding line arranged in a diagonal manner so that the box body can be folded into a flat manner by pushing the two long upright peripheral panels toward each other and then respectively turning the two short upright peripheral panels toward the attached two long upright peripheral panels.

6 Claims, 3 Drawing Sheets

FOLDING COLLAPSIBLE RECTANGULAR STORAGE BOX

BACKGROUND OF THE INVENTION (a) Technical Field of the Invention

The present invention relates a rectangular storage box for keeping things and more particularly, to such a rectangular storage box that is folding collapsible.

(b) Description of the Prior Art

In order to save storage space, many storage box suppliers provide different designs of folding collapsible storage boxes. A folding collapsible storage box is known comprising a flexible rectangular cloth box body and a plurality of rod members supporting the cloth box body in shape. These rod members include four horizontal top rods, four horizontal bottom rods, and four vertical corner rod members. When assembled, the rod members are kept spaced from one another at a distance so that the storage box can be twisted and then folded into a flat status having a reduced size. This structure of storage box is complicated and not convenient to operate. Further, this storage box does not have a stiff outer appearance because it uses a cloth material for the box body. If a hard or stiff material is used for the box body, the storage box becomes not collapsible.

SUMMARY OF THE INVENTION

The primary purpose of the present invention is to provide a rectangular storage box, which is folding collapsible. It is another object of the present invention to provide a rectangular storage box, which has a simple structure and is easy to operate. To achieve these and other objects of the present invention, the folding collapsible rectangular storage box comprises a rectangular box body. The rectangular box body comprises a flexible rectangular bottom panel, and two short upright peripheral panels and two long upright peripheral panels perpendicularly extending upward from the four sides of the rectangular bottom panel. Each long upright peripheral panel has a folding line extending across the height thereof. The folding line divides the respective long upright peripheral panel into a small panel wall portion and a big panel wall portion. The small panel wall portion and big panel wall portion of one long upright peripheral panel are arranged in a diagonal manner relative to the small panel wall portion and big panel wall portion of the other long upright peripheral panel. The short upright peripheral panels have a horizontal length greater than the small panel wall portion but smaller than the big panel wall portion. Therefore, the rectangular box body can be folded into a flat manner by pushing the two long upright peripheral panels toward each other and then respectively turning the two short upright peripheral panels toward the attached two long upright peripheral panels.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
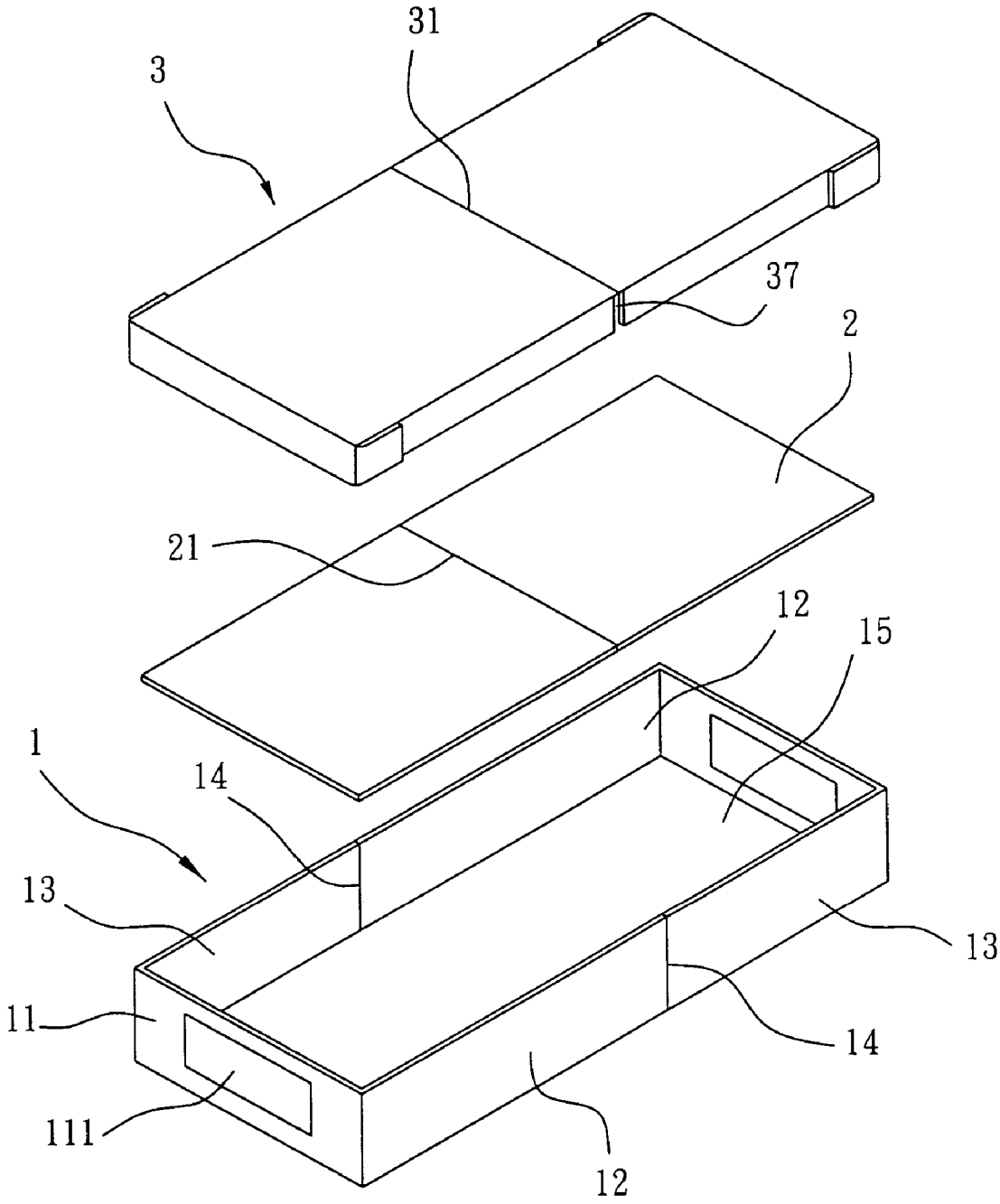
FIG. 1 is an exploded view of a rectangular storage box according to the present invention.

Referring to FIG. 1, a rectangular storage box in accordance with the present invention is shown comprising a rectangular box body 1, a rectangular reinforcing bottom plate 2, and a rectangular box cover 3.

The rectangular box body 1 comprises a rectangular bottom panel 15, and two short upright peripheral panels 11 and two long upright peripheral panels perpendicularly extending upward from the four sides of the rectangular bottom panel 15. Each long upright peripheral panel has a folding line 14 extending across the width (height) and is divided by the folding line 14 into a small panel wall portion 13 and a big panel wall portion 12. The small panel wall portion 13 and big panel wall portion 12 of one of the two long upright peripheral panels are arranged in a diagonal manner relative to the small panel wall portion 13 and big panel wall portion 12 of the other of the two long upright peripheral panels. The size (horizontal length) of the short upright peripheral panels 11 is greater than the small panel wall portion 13 but smaller than the big panel wall portion 12. The rectangular bottom panel 15 is made of a flexible sheet material, for example, canvass, flexible plastic sheet material, synthetic leather, or the like. The short upright peripheral panels 11 and long upright peripheral panels of the rectangular box body 1 are made of stiff material and covered with a covering of flexible material. The short upright peripheral panels 11 and long upright peripheral panels of the rectangular box body 1 are kept spaced from one another at a crevice and linked to one another by the covering of flexible material so that the rectangular box body 1 can be conveniently folded into a collapsed status. Further, a transparent view window 111 is formed in each of the two short upright peripheral panels 11 of the rectangular box body 1. Alternatively, a view window can be formed in the big panel wall portion 12 or small panel wall portion 13 of each the two long upright peripheral panels of the rectangular box body 1.

Figure 2:
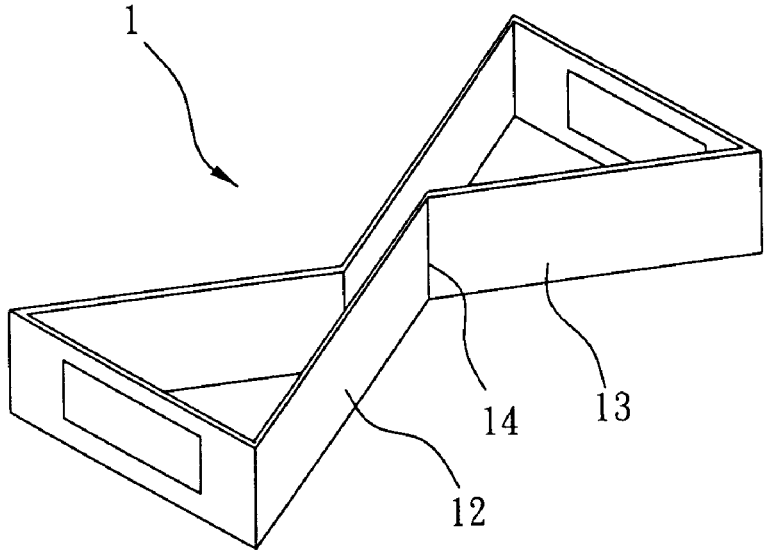
FIG. 2 is a schematic drawing showing the folding action of the box body of the rectangular storage box according to the present invention (I).
Figure 3:
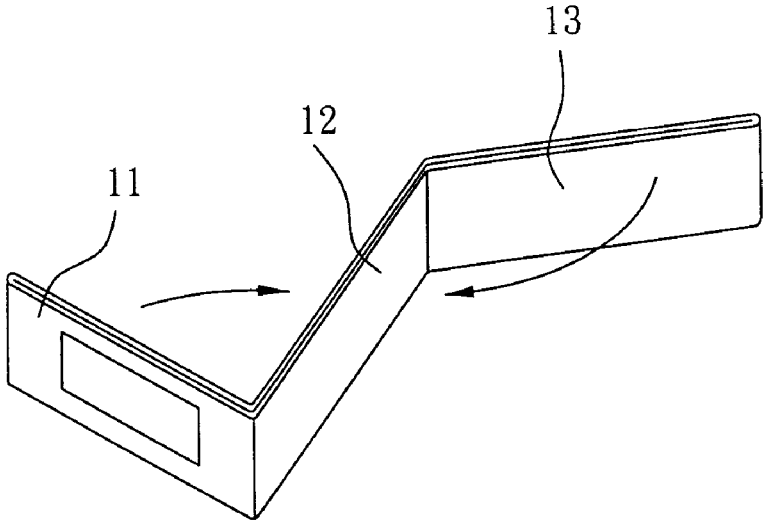
FIG. 3 is a schematic drawing showing the folding action of the box body of the rectangular storage box according to the present invention (II).
Figure 4:
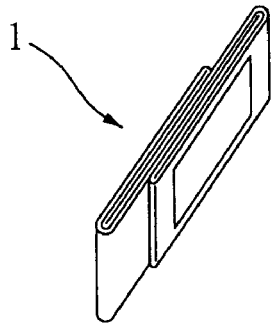
FIG. 4 is a schematic drawing showing the folding action of the box body of the rectangular storage box according to the present invention (III).

Referring to FIGS. 2~4, by pushing the two long upright peripheral panels of the rectangular box body 1 toward each other (see FIG. 2) and then respectively turning the two short upright peripheral panels 11 of the rectangular box body 1 toward the attached two long upright peripheral panels of the rectangular box body 1 (see FIG. 3), the rectangular box body 1 is collapsed into a flat condition (see FIG. 4).

Figure 6:
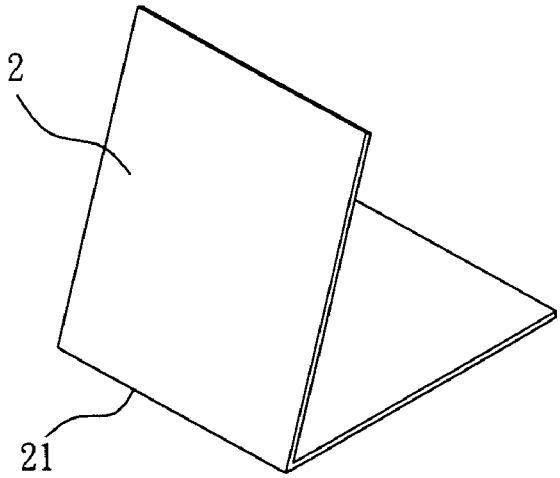
FIG. 6 is a schematic drawing showing the folding action of the reinforcing bottom plate of the rectangular storage box according to the present invention.

Referring to FIG. 6 and FIG. 1 again, the reinforcing bottom plate 2 fits over the flexible bottom panel 15 of the rectangular box body 1 for supporting storage items. The reinforcing bottom plate 2 has a folding line 21 transversely extending to the two long sides thereof. Through the folding line 21, the reinforcing bottom plate 2 can be folded up to save storage space.

Figure 5:
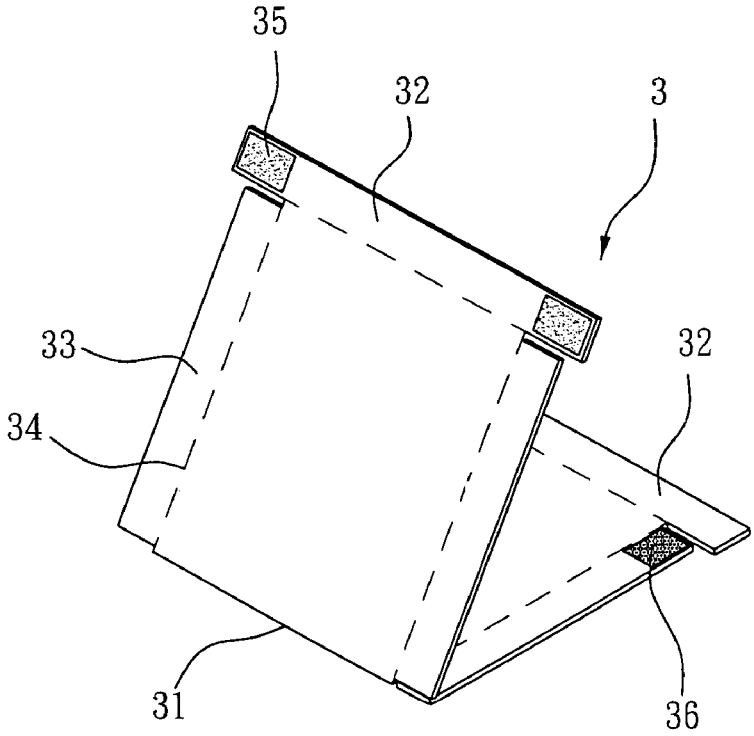
FIG. 5 is a schematic drawing showing the folding action of the box cover of the rectangular storage box according to the present invention.

Referring to FIG. 5 and FIG. 1 again, the rectangular box cover 3 comprises four border folding lines 24 respectively disposed at four sides defining two end flaps 22 at two short sides thereof and two side flaps 23 at two long sides thereof, a middle folding line 31 transversely extending between the two long sides, a plurality of first fastening members, for example, male fastening members 35 respectively provided at the ends of the end flaps 32 at an inner side, and a plurality of second fastening members, for example, female fastening members 36 respectively provided at the ends of the side flaps 33 at an outer side corresponding to the male fastening members 35. According to this embodiment, the male fastening members 35 are strips of hook material, and the female fastening members 36 of strips of loop material connectable to the strips of hook material. By means of turning the end flaps 32 and the side flaps 34 from a horizontal position to a vertical position and then securing the respective male fastening members 35 to the respective female fastening members 36, the rectangular box cover 3 is set in shape. When not in use, the male fastening members 35 are respectively disengaged from the respective female fastening members 36, and then the end flaps 32 and the side flaps 33 are respectively turned outwards from the vertical position to the horizontal position, and then the rectangular box cover 3 is folded up (see FIG. 5).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A folding collapsible rectangular storage box comprising a rectangular box body, wherein said rectangular box body comprises a flexible rectangular bottom panel, and two short upright peripheral panels and two long upright peripheral panels perpendicularly extending upward from the four sides of said rectangular bottom panel, each said long upright peripheral panel having a folding line extending across the height thereof, said folding line dividing the respective long upright peripheral panel into a small panel wall portion and a big panel wall portion, the small panel wall portion and big panel wall portion of one of said two long upright peripheral panels being arranged in a diagonal manner relative to the small panel wall portion and big panel wall portion of the other of said two long upright peripheral panels, said short upright peripheral panels having a horizontal length greater than said small panel wall portion but smaller than said big panel wall portion, wherein said folding lines and said flexible bottom permit said small panel wall portions to be positioned against respective of said short upright peripheral panels and said big panel wall portions to be positioned against each other during collapse of the rectangular storage box.

2. The folding collapsible rectangular storage box as claimed in claim 1, wherein each said short upright peripheral panel has a view window.

3. The folding collapsible rectangular storage box as claimed in claim 1, further comprising a rectangular reinforcing bottom plate fitted over the flexible bottom panel of said rectangular storage box for supporting storage items.

4. The folding collapsible rectangular storage box as claimed in claim 3, wherein said rectangular reinforcing bottom plate has a folding line extending to the two opposite long sides thereof.

5. The folding collapsible rectangular storage box as claimed in claim 1, further comprising a rectangular box cover for covering said rectangular box body.

6. The folding collapsible rectangular storage box as claimed in claim 5, wherein said rectangular box cover has a folding line through which said rectangular box is foldable.

* * * * *